US005223359A

United States Patent [19]

Shelton et al.

[11] Patent Number: 5,223,359

[45] Date of Patent: Jun. 29, 1993

[54] DETERMINATION OF WET PRESSURE SENSITIVITY OF A FILM

[75] Inventors: Kenneth L. Shelton, Rosman; B. J. Klein, Hendersonville; James R. Woodroffe, Penrose, all of N.C.

[73] Assignee: E. I. Du Pont de Nemours and Company, Wilmington, Del.

[21] Appl. No.: 557,651

[22] Filed: Jul. 25, 1990

[51] Int. Cl.[5] ..... G03C 5/00

[52] U.S. Cl. ..... 430/30; 430/403; 430/607; 436/164; 436/905

[58] Field of Search ..... 430/30, 403, 607; 436/164, 905

[56] References Cited

U.S. PATENT DOCUMENTS

| | | | |
|---|---|---|---|
| 4,861,702 | 8/1989 | Suzuki et al. | 430/403 |
| 4,900,652 | 2/1990 | Dickerson et al. | 430/502 |
| 5,026,632 | 6/1991 | Bagchi et al. | 430/545 |
| 5,066,572 | 11/1991 | O'Connor et al. | 430/503 |

OTHER PUBLICATIONS

"1992 Standard Postage Stamp Catalog", vol. 1, Scott Publishing Co., 1991, pp. 17A-19A.

*Primary Examiner*—Charles L. Bowers, Jr.
*Assistant Examiner*—Thomas R. Neville

[57] ABSTRACT

Wet pressure sensitivity of a film having a silver halide coating is indirectly determined by measurement of a difference in density of a coating area which has increased pressure applied thereto compared to a coating area without such increased pressure.

1 Claim, 1 Drawing Sheet

DETERMINATION OF WET PRESSURE SENSITIVITY OF A FILM

FIELD OF THE INVENTION

This invention relates to a method for determining the wet pressure sensitivity of a photosensitive silver halide coating through a technique of film density measurement.

BACKGROUND OF THE INVENTION

Physical stress on a silver halide emulsion capable of deforming the silver halide grains or disrupting the silver halide-gelatin surface generally correlates to a negative photographic effect. Such stress may result in an increase in emulsion density, i.e., fog, or desensitization, or the destruction of already existing latent image. Silver halide emulsions are soft materials, with less hardness than dry gelatin, so that excessive sharp bending of a film, or excessive local stretching, causes marks in the area involved. In general, the effect of stress after exposure of the photosensitive material is less than those produced upon an unexposed emulsion. If the film is sharply bent, a usual result is an appearance of fog or an increase in density along the line of bending and desensitization. Typical cases of pressure marks occur when film is kinked, when a large sheet is handled and when film is pulled under tension around a small roller, especially if the motion is intermittent; or when film is stretched near sprocket holes.

Photosensitive materials are likely to be pulled under tension or stretched by rollers while in a processing apparatus while undergoing development with a developer solution of a latent image to a visible image. In particular, the detrimental effects of tension and stretching on the photosensitive material manifest themselves as pressure marks when the photosensitive material is transported through the development section of a processing apparatus. These pressure marks which occur while in the development section of a processor are usually called "wet pressures". Sensitivity resulting in wet pressure marks may be affected to a different degree or even in opposite directions by different types of photosensitive materials, i.e., x-ray, medical, graphics arts, etc.

Thus far, prior methods for determining the sensitivity of a photosensitive material to wet pressure induced marks have not been reproducible and have been cumbersome and time consuming. Prior to the discovery of this invention, pressure in photosensitive material film was introduced by disassembling a roller of a processing apparatus, wrapping a tape around the roller and then reassembling the roller in a processor. This method was generally not successful since the tape tended to unwrap and loosen on the roller due to the wet chemistry. Also, the results were highly dependent upon operator technique.

It is therefore an object of this invention to provide a quick and easy-to-accomplish method for determining the wet pressure sensitivity of silver halide photosensitive materials.

SUMMARY OF THE INVENTION

The present invention is directed to a method for determining wet pressure sensitivity of a film having a base with a silver halide coating thereon by measuring film density comprising the steps of:

(a) applying developer solution to wet the silver halide coating of said film;

(b) passing said wetted film between two surfaces which contact the film with one of the surfaces being a roller which has a raised surface portion wherein said raised surface portion does not completely encircle the roll and wherein a first area of the coating has increased pressure applied thereto by the raised surface portion and a second adjacent area of the film does not have increased pressure applied due to the raised surface portion not encircling the roll;

(c) measuring film density in the first area and measuring film density in the second adjacent area; and (d) determining a difference in film density between the two areas.

In a preferred mode both surfaces which contact the film are rollers.

DETAILED DESCRIPTION OF THE INVENTION

Figure 1:
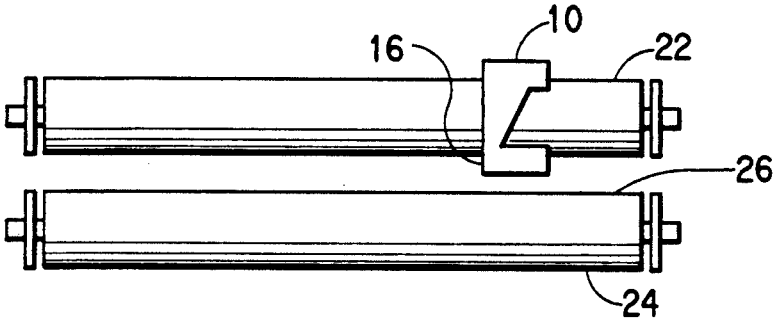
FIG. 1 is a front view of a pair of rollers used in a silver halide processing apparatus in which a raised surface portion partially encircles one of the rollers.

To record an image on a photosensitive material, such as a photographic film, the photosensitive material is imagewise exposed, for example to actinic light or electromagnetic radiation and then the exposed material is fed into a developing apparatus. In the developing apparatus, also referred to as a processor, the exposed photosensitive material is processed as it passes through a series of developing, fixing and washing tanks which are usually arranged consecutively. The developed material is then dried. This process results in the image being permanently recorded on the film. Transport of the material through the series of tanks must be closely controlled in order to accurately develop a quality image on the material. The apparatus typically comprises a transport mechanism having a multiplicity of rollers, gears, and guides which are sometimes grouped together as racks for easy submersion into the appropriate processing tank. As such, developing apparatuses are generally complex, difficult to maintain and cumbersome to service. Poorly maintained developing apparatuses generally create conditions which induce pressure marks on the transported film. Therefore a determination of wet pressure sensitivity, i.e., sensitivity to stress is important in the formulation of an emulsion. Excessive wet pressure sensitivity will denote a propensity of the emulsion to develop defects due to stress. Further, a determination of wet pressure sensitivity of a film is particularly important when the material is used in critical situations such as in the medical and industrial x-ray fields. A stray mark, such as present due to a difference in film density or otherwise manifested defect on an x-ray film can result for example in a medical misdiagnosis or error in equipment testing such as a jet engine weld. In development of a new silver halide coating, e.g., a superior emulsion will possess a decreased wet pressure sensitivity as determined in accordance with the measurement technique as discussed herein.

Wet pressure upon silver halide materials results when an emulsion or photosensitive layer is swollen by a developing solution before an image is fixed, so that wet pressure marks can be induced while the material is undergoing development. Typically, the developer solution is applied to the film material as it is transported through a section of a silver halide processor which contains developer solution. However, the developer solution can be applied to the film by any method, for example, dipping, spraying, etc. Developer solutions conventional in the art are suitable for use in this invention. The conditions for development, such as development time, temperature of the developer, etc., are conventional and are chosen to be appropriate to the type of photosensitive material being evaluated. In the present invention the wet pressure sensitivity is determined by a measurement of density or two surface areas, i.e., a final area which has increased pressure applied thereto and a second area which does not have this increased pressure application.

Suitable for use in this invention are conventional silver halide processors in which there is at least one pair of opposing rollers. The location of rollers and in the development section is not critical provided the film passes between the rollers and preferably while being transported through the processor. It is preferred to have the rollers and close to or at the exit of the development section, before entry into a fixer section of the processor. It is preferred to have the rollers and mounted on an easily removable rack, such as a developer-to-fixer crossover rack, so that the rack only need be exchanged when other processing is desired.

The method of this invention can be understood by referring to the drawings. FIG. 1 illustrates an embodiment of this invention in which a substantially ring-like band 10 which represents a raised surface portion is located on a roller 22 opposite a second roller 24 in a development section of a processing apparatus. This ring-like band applied increased pressure to a first area of a silver halide coating.

Figure 2:
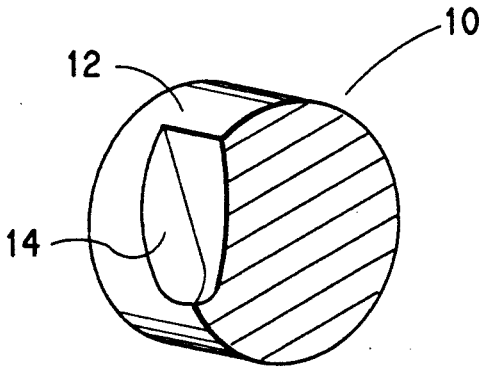
FIG. 2 is a perspective view of a band which forms a raised surface portion on a roller.

The band 10 can be attached to the roller 22 by press or force fitting or by other means. The thickness of the band is not critical; however, the band 10 should be of sufficient thickness in order to create the raised surface portion 16 on the roller 22. By passing the photosensitive material between the raised surface portion 16 of roller 22 and the second roller 24 an increased pressure is applied onto the photosensitive layer to deform the coating. Such increased pressure is considered to either sensitize or desensitize the silver halide grains in the coating substrate of the photosensitive material. The clearance between the raised surface portion 16 or outer surface 12 of the band 10 and the surface 26 of the second roller 24 can be typically between 2 to 4 mils, preferably about 3 mils for a film of 7–9 mils. The shape of the band 10 is not critical provided it allows alternating areas on the coating to allow increased pressure applied thereto and areas which do not have such increased pressure due to alternating areas of contact with the raised relief. It is preferred to have a cut out portion or notch 14 in the band 10 to indicate the pattern of repeat for ease in measurement. FIG. 2 illustrates the band 10 with a suitable notch 14. The band 10 can be located anywhere along the length of the roller 22. However, it is preferred to locate the band 10 at or near an end of the length of the roller 22 since the forces between the rollers 22 and 24 generally are consistent where there is substantially no bowing of the rollers. Material suitable for use as the band 10 is not critical but should be sufficiently hard to apply pressure on the silver halide coating and resilient to the chemical environment of the developing section. A preferred material for the band 10 is stainless steel. Although the band in FIGS. 1 and 2 is shown in one area as completely encircling the roll, it is essential that the band does not completely encircle the roll in all areas. Alternate forms employing a raised relief can be employed, e.g., a bump or series of bumps on a roll.

The use of a roll having a raised surface portion which does not completely encircle such a roller provides a protected area along a direction of film travel wherein increased pressure is not applied due to a raised surface portion of the roller. Such protected area is considered to facilitate reproducibility in the test procedure either on the same film or in comparative testing of two different films.

After the film has passed between the rollers 22 and 24 and through the remaining sections of the processor, the coating will have an area of different density where it contacts the raised area of the band. Such areas can be in any shape including a striped area based on the pressure contact of the band 10 on the material.

Thereafter measurement of density on two areas takes place. Measurement of density on a photosensitive material is well known to those skilled in the art and is conventionally accomplished with a densitometer and/or microdensitometer. A suitable discussion on the subject is in the *SPSE Handbook of Photographic Science and Engineering,* W. Thomas, Jr., ed., Section 15 "Densitometry", John Wiley and Sons, 1973. The measurement of density is made in adjacent locations on the material in respect to the contacted and the non-contacted areas of the coating along a line or areas directly behind one another in a direction of film travel. Several density measurements in both the contacted and non-contacted areas of the material are preferably made and the measurements averaged. The difference in density of the areas of the coating not contacted by the raised surface portion 16 of the roller 22 and the areas of the photosensitive material contacted by a portion of the raised surface 16 represents a sensitivity measurement of photosensitive material to wet pressure. A greater density difference is considered to denote increased sensitivity of a film to wet pressure sensitivity. The test for wet pressure sensitivity realized by a determination of a difference in sensitivity on a coating of a film is not an absolute test in the sense that an optimum value will be dependent on the materials of construction of the film. Thus for one type of coating emulsion an optimum value will differ compared to another class of emulsion coating. The present test herein is considered a comparative or relative test, i.e., of two different films the film with a lower difference in film density will be considered to have less wet pressure sensitivity.

For the test procedure, the photosensitive material can be preflashed or preexposed by a suitable exposure source, before undergoing development and increased pressure application by the process of this invention. Typically the preexposure flash is to density in the range of 1.0 to 3.0.

Silver halide photosensitive and/or radiation sensitive materials useful with the present invention may be any which are well-known for imaging and reproduction in fields such as graphic arts, printing, medical, industrial and information systems. Photographic silver halide emulsions employing any of the commonly known halides (e.g., bromide, chloride, iodide or mixtures of two or more) may be used. These may be of varied content and can include the various addenda, such as dyes, surfactants, hardeners, etc., known in the photographic art for photographic silver halide emulsions. Further, substrates for the photosensitive materials which may be used in this invention are papers or films composed of various film-forming synthetic resins or high polymers.

Although in the preceding description the use of two rollers has been described it is understood that only a single roller need be employed.

To further illustrate the present invention the following example is provided.

EXAMPLE 1

A ring-like band was formed of stainless steel with a wall thickness 0.026 in. (0.66 mm) so that the band had an inside diameter of 1 in. (25.4 mm). The face of the band was 1 in. (25.4 mm) wide at its greatest width and had a substantially wedge-shaped notch cut out. The notch was shaped with a 0.25 in. (6.35 mm) cut perpendicular to and from a side edge of the face of the band, at which point it angled at 60° toward the side edge opposite the first side and continued at this angle until it was 0.25 in. (6.35 mm) from the opposite side, and returned perpendicular to the first side edge.

A developer-to-fixer crossover rack of an industrial X-ray processor, Model "B" (sold by Kodak, Rochester, N.Y.) was modified by force fitting the band described above onto a film transport roller of the crossover rack to form a substantially raised surface on the roller. The center of the band was located 3.5 in. (89 mm) in from the end of the roller. The roller was an outside roller of the first pair of opposing rollers, located at entrance of the crossover rack before the film turnaround. The clearance between the raised portion of the modified roller and its opposing roller was 0.003 in. (0.076 mm).

Two types of industrial x-ray film, types NDT 55 and NDT 75 (sold by E. I. du Pont de Nemours and Company, Wilmington, Del.) were individually x-ray exposed on a PANTAK HF-420C Industrial X-Ray Unit (sold by EGG Astrophysics, Inc., Long Beach, Calif.) to a uniform 2.0 density.

The industrial processor with the modified crossover rack was operated as follows:

A developer solution NDTAD (sold by E. I. du Pont de Nemours and Company) was maintained at about 86° F., a fixer solution was type XMF sold by E. I. du Pont de Nemours and Company maintained at 86° F., a wash water at 84° F. and a dryer at 120° F. were employed. Tested films were processed with a development time 95 seconds following by about 7.5 min. to dry. The entry of the film into the processor was arranged so that the emulsion layer on the film contacted the raised surface of the modified roller as the film transported through the developer-to-fixer crossover rack and thus induced a repeatable pattern of pressure marks of increased density on the emulsion layer while wet with the developer solution.

Each of the wet pressure marks for both film types was scanned on a microdensitometer Joyce Loebl Model 3CS scanning microdensitometer sold by Joyce Loebl Limited, Gateshead, England, to give a relative density increase above the background density. Each of the wet pressure marks induced by the repeatable pattern of the raised roller surface were read in the same relative location of the mark when scanned on the microdensitometer. A calibration strip of known densities was used to attain calibrated density values from the relative density values. The difference between the calibrated background density and the calibrated increased density average of the wet pressure mark indicated the wet pressure sensitivity of the films. Individual readings were averaged and the results were:

| Type | Density Difference |
|---|---|
| Film A NDT55 | 0.226 |
| NDT75 | 0.007 |

Film NDT75 was considered vastly superior to Film A NDT55 due to a lesser density difference and thus a lesser sensitivity to wet pressure.

What is claimed is:

1. A method for determining wet pressure sensitivity of a film having a base with a silver halide coating thereon by measuring film density comprising the steps of:

(a) applying developer solution to the silver halide coating of said film;

(b) passing said film between two surfaces which contact the film with one of the surfaces being a roller which has a raised surface wherein said raised surface portion does not completely encircle the roll and is a substantially ring-like band having a cut out portion and wherein a first area of the coating has increased pressure applied thereto by the raised surface portion and a second adjacent area of the film does not have increased pressure applied due to the raised surface portion not encircling the roll;

(c) measuring film density in the fist area and measuring film density in the second adjacent area; and (d) determining a difference in film density between the two areas.

* * * * *